US005154150A

United States Patent [19]

Vieira

[11] Patent Number: 5,154,150

[45] Date of Patent: Oct. 13, 1992

[54] REMOTE-START, FAIL-SAFE, DUAL-MODE, ENGINE THROTTLE CONTROL

[76] Inventor: John Vieira, P.O. Box 146, Glade Park, Colo. 81523

[21] Appl. No.: 654,537

[22] Filed: Feb. 13, 1991

[51] Int. Cl.[5] ..... F02D 17/04; F02D 11/00

[52] U.S. Cl. ..... 123/396; 123/198 D

[58] Field of Search ..... 123/198 D, 396, 378

[56] References Cited

U.S. PATENT DOCUMENTS

| | | | |
|---|---|---|---|
| 3,379,187 | 4/1968 | Armbrust | 123/198 D |
| 3,456,637 | 7/1969 | Bjorknas | 123/198 D X |
| 4,106,468 | 8/1978 | Davis | 123/198 D X |
| 4,729,355 | 3/1988 | Barnes | 123/198 D X |

*Primary Examiner*—Tony M. Argenbright

[57] ABSTRACT

An electromechanical/hydraulic assembly controlled by circuit board, acting on an engine throttle so as to allow for remote control and engine fault protection. An idle solenoid pushes and slides a captive throttle rod through a linear translation bracket so as to move engine throttle to idle position for fixed time upon starting. Engine oil pressure flows through a controlled check valve in reduced flow direction into a solenoid valve and then into a hydraulic cylinder to gradually advance indirectly attached throttle to operating position. Hydraulic cylinder, through pivoted lever, actuates a switch at proper engine speed so as to connect generator load. Upon pushing off button, load is disconnected. Solenoid valve de-energizes blocking oil flow into hydraulic cylinder and allows cylinder to retract under spring pressure by exhausting cylinder into engine sump through drain circuit of solenoid valve. Throttle will then return to "idle" or "off" depending on idle solenoid mode as determined by stand-by mode switch position. Oil pressure failure will shut down engine by emptying hydraulic cylinder regardless of sensor circuit failure or other component mode. A sensed failure in properly operating system, turns off solenoid valve and provides sump path from hydraulic cylinder. Controlled check valve will release oil back to engine upon oil pressure failure to engine if solenoid valve, for whatever reason, does not return to "off" position.

3 Claims, 1 Drawing Sheet 9
8
7
18
17
15
2
6
14
10
3
4
16
12
22
13
5
11
19
1
20
21

REMOTE-START, FAIL-SAFE, DUAL-MODE, ENGINE THROTTLE CONTROL

BACKGROUND OF THE INVENTION

Figures 1, 2, 3, 4:
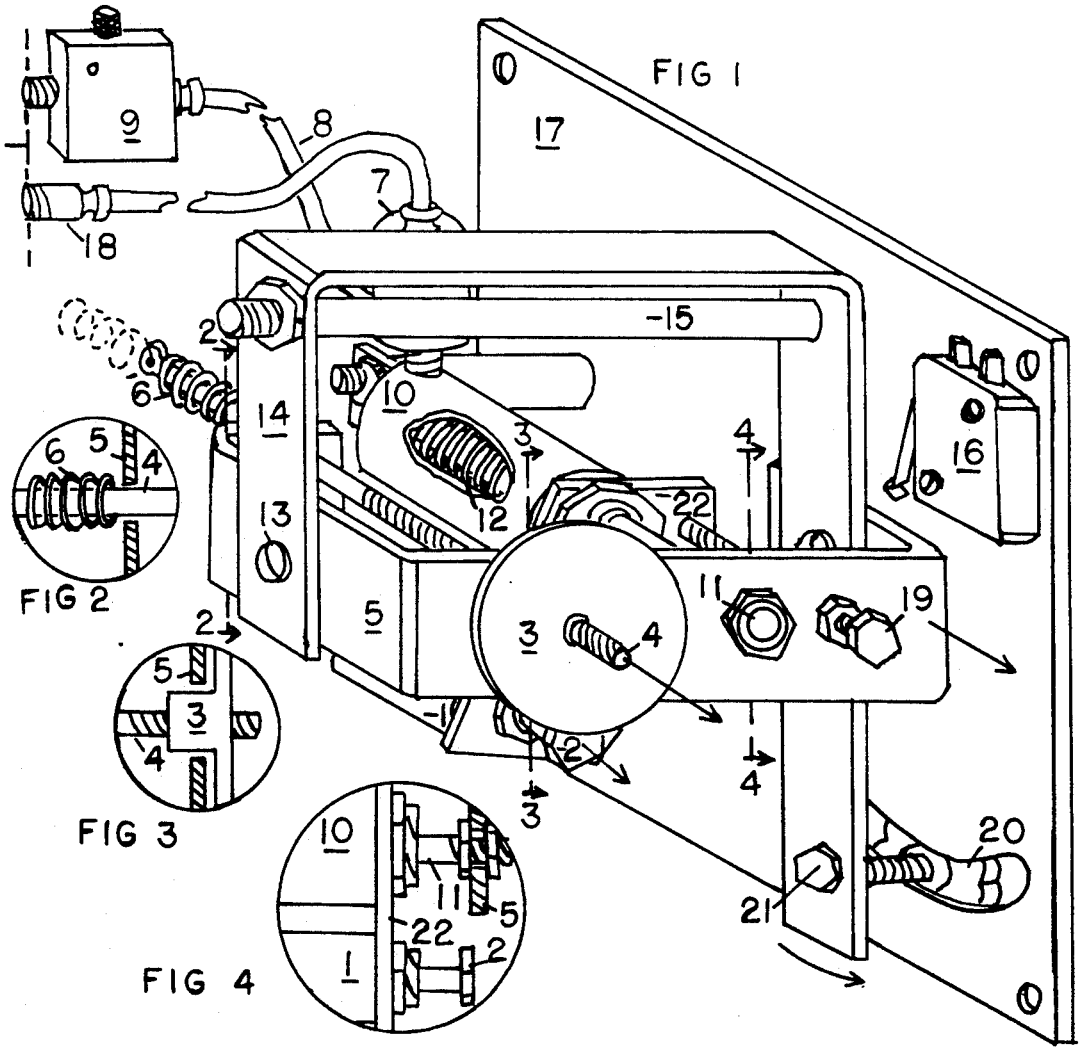

This invention relates to the remote-control, load switching, protection and enhancement of reliability and longevity of applications of the internal combustion engine, more especially as to diesel generator stand-by use.

Prior art devices realize one or more of these objectives, but to the best of inventor's knowledge, the instant invention is the first to provide ALL of the above in a simple, inexpensive and easily applied device.

Some engine safety devices provide for engine shut-down upon sensing of oil pressure loss, by means of fuel system starvation. Such is undesirable as requiring manual priming for restart and, furthermore, is destructive of injector pump in diesel applications.

Other throttle-active safeties operate upon the throttle without starving the fuel system and there by avoid such drawbacks. This class of devices are usually much more complex, as found in U.S. Pat. No. 4,729,355 oil pressure regulator and complicated valve requirements. Still others, as well as afore-said device, require an auxiliary fluid power source, and further rely upon pressure ratios, as in U.S. Pat. No. 4,106,468, rather than one absolute pressure for operation. Many, as in U.S. Pat. No. 3,379,187 are designed to provide proportional slow-down only, upon a fault condition, with said sighted reference also requiring a pumped-flow-coolant system to operate its mechanical coolant system fault sensor. Few are fail-safe in system operation. Some are single purpose add-ons. U.S. Pat. No. 3,456,637 discloses a throttle protective device designed solely for purpose of preventing engine speed overshoot upon start, in order to preclude engine shut-down upon overshoot, by other, non included means. Said device does not provide for throttle off positioning. Nor can it reset to idle position, in no-fault operation, until after other non included means has shut-down engine. Furthermore, in this example, fluid pressure is applied to weak, leak-prone, side of hydraulic cylinder.

Since all above cited references disclose mechanical, hydraulic, and/or pneumatic operated devices, devoid of electrical control means, they do not readily lend themselves to remote start/stop application. Nor do they provide a simple inexpensive means of realizing benefits to be derived from automatic engine warm-up/cool-down during cycling.

Instant invention was conceived to, and does, combine remote-controlled start/stop, automatic adjustable proportional warm-up/cool-down time dependent upon engine/ambient temperature, load-switching, fault shut-down, idle/off stand-by select, enhancement of reliability and longevity ALL in one simple, reliable and inexpensive device requiring no modification of engine and being simple to install. Remote control may be realized by simple switches or automated circuitry. This device provides for protection from oil pressure, temperature, and other fault conditions by simple connection of off-the-shelf inexpensive electrical switch transducers such as found on automobiles. Furthermore, redundant and fail-safe oil pressure fault protection is inherent and self-contained within this invention by virture of combination of return spring, controlled-check valve, and electrical solenoid valve type. Since instant device is also inherently free from speed overshoot, and limits maximum throttle setting to preset value, no additional means of protection, as found in U.S. Pat. No. 3,456,637, is necessary. In governor applications, though governor is under firm control of invention, it is free to react to load changes upon engine. Perusal of instant disclosure, instructs same may perform functions of references and more.

SUMMARY OF THE INVENTION

Device is an inherently fail-safe electronically controlled electromechanical/hydraulic attachment for engine governor or throttle actuation by remote signal, comprised of a push solenoid, flow control check valve, solenoid valve, hydraulic cylinder, switch, levers, tubing, and circuit board control, in combination, providing: remote start; fault-detection engine shut-down; temperature variable gradual throttle advance; automatic electrical load switching; remote timed cool-down/shut-down; selection of idle or engine off stand-by mode; and incorporating a manual bypass.

Objective

A means of improving engine/generator, or other constant-speed load, internal combustion engine longevity, reliability, and convenience of operation by providing for automatic: temperaturedependent engine warm-up time; gradual throttle advance; load application only upon warm-up and proper engine speed; and engine cool-down prior to shut-down except upon a fault condition.

While engine may be protected by connecting of various common sensors to identify fault conditions and shut-down the engine, system also inherently provides:

1. Fail-safe for engine on oil pressure loss, as such fault will cause quick shut-down of engine regardless of status of, or failure mode probable in, sensors, circuitry, or system's solenoid control valve.
2. Shorter start to operating speed warm-up period upon warmer ambient or engine. Colder ambient and engine automatically produces longer warm-up period.

Additionally, dual mode to allow for choice between shut-off or return to idle as stand-by options to further enhance engine longevity and reliability, as well as convenience, especially for diesels, especially in extreme cold weather.

An also provide for wired, or radio, remote-controlled: start-up; up-to-speed; load switching; and return to stand-by. Start-up to up-to-speed time inversely proportional to ambient temperature. But, previously run, or otherwise, engine at above ambient temperature will experience faster start-up to up-to-speed time. Having been reduced to practice, the device has achieved its objectives.

Principle of operation

1. Spring-returned hydraulic throttle control suppled by engine lube oil system inherently and reliably returns throttle to off position upon oil pressure loss, and regardless of, most system failures. If solenoid valve holds "on" mode when a engine oil pressure failure occurs, hydraulic cylinder return spring empties oil from cylinder through "cylinder" to "source" port of solenoid valve. Oil flow is then through full-flow path of controlled-flow check valve back into the engine since loss of engine oil pressure releases check valve. If solenoid valve is in "off" mode when oil pressure failure occurs, oil path is from cylinder, through "cylinder" to "exhaust" port of solenoid valve, to engine sump through drain tube.

2. Oil viscosity is greater when cold. Therefore, a given volume of oil flows through a controlled aperture in a finite amount of time variable with temperature and size of orifice. For a specific ambient temperature, a given volume of oil will flow through an orifice in a longer or shorter time span according to size of orifice or temperature of the oil. Time from engine turn-on to full throttle and load connect can therefore be set by adjustable orifice to allow sufficient engine warm-up to enhance engine longevity and reliability. Once set, warm-up time will vary automatically in accordance with need. Colder ambient temperature and cold oil cause longer transit times. A warmer ambient or warmer engine causes a shorter warm-up time.

A system exhibiting properties as described in 1. and 2. above, when coupled to a solenoid, properly fashioned levers, sensors, and controls is conductive of remote control and further engine protection.

Method of application

Device is attached to engine so as to allow straight-line operation on governor spring or throttle. Electromechanical/hydraulic assembly is wired to circuit board, tubing connected, fault sensors attached to engine, and remote switches or radio control added.

DRAWINGS

FIG. 1 Isometric perspective view of device in "off" position seen from backside of mounting plate, looking back at engine's throttle lever spring which is shown in phanthom. Shown in partial cut-away is spring-return hydraulic cylinder so as to show return spring providing stored energy to return device to stand-by.

FIGS. 2–4 are three detail views showing the linear translation bracket in vertical section at points of detail.

DESCRIPTION/OPERATION

The instant invention is best understood by referring to FIG. 1, its detail FIGS. 2, 3, 4 and the following description of preferred imbodiment. The device is built around a throttle rod attachment for engine governor and so arranged as to impart movement and control to said governor.

Adjustable Attachment means—THROTTLE ROD (4) is threaded on one end to accept THROTTLE ROD ADJUSTER DISC (3) and having an eye on other end to accept engine governor spring. THROTTLE ROD ADJUSTER DISC (3) includes a boss that allows for smooth sliding motion of THROTTLE ROD (4) whose effect length may be set by rotation of THROTTLE ROD ADJUSTER DISC (3). THROTTLE ROD (4) is held to movement primarily in the horizontal plane by restrictions imposed by TRANSLATION BRACKET (5).

Translation Bracket means—LINEAR TRANSLATION BRACKET (5) contains holes sized for accepting THROTTLE ROD (4) and boss of THROTTLE ROD ADJUSTER DISC (3). THROTTLE ROD (4) is held against static position by THROTTLE ROD RETURN SPRING (6) which is positioned onto THROTTLE ROD (4) between eye end and nearest surface of LINEAR TRANSLATION BRACKET (5). LINEAR TRANSLATION BRACKET (5) is also threaded to accept PARK SCREW (19) which bears upon IDLE SOLENOID MOUNT (22) and is an adjustment for THROTTLE ROD (4) positioning.

Hydraulic Actuator means—HYDRAULIC CYLINDER (10) includes HYDRUALIC CYLINDER ROD (11) which is attached to LINEAR TRANSLATION BRACKET (5) with HYDRAULIC CYLINDER (10) pivot mounted at opposite end to MOUNTING PLATE (17). HYDRAULIC CYLINDER ROD (11) is held in retracted position by Stored Energy means of CYLINDER RETURN SPRING (12) which is mounted on HYDRAULIC CYLINDER ROD (11) within HYDRAULIC CYLINDER (10) and bears against piston end of HYDRAULIC CYLINDER ROD (11) on one side, other side bearing against HYDRAULIC CYLINDER (10) end cap. HYDRAULIC CYLINDER (10) is ported at end having pivot mounted end cap. HYDRAULIC CYLINDER ROD (11) end of HYDRAULIC CYLINDER (10) body is threaded to accept and position IDLE SOLENOID MOUNT (22). IDLE SOLENOID MOUNT (22) is a flat drilled on one end to attach to HYDRAULIC CYLINDER (10) with other end drilled to accept IDLE SOLENOID (1).

Electrical Solenoid means—IDLE SOLENOID (1) is push type positioned so electrical signal applied to IDLE SOLENOID (1) will cause included IDLE SOLENOID ARMATURE (2) to move foward, strike THROTTLE ROD ADJUSTER DISC (3) and there by THROTTLE ROD (4) is caused to travel to position corresponding to engine idle from stop position.

Electrical Solenoid Valve means—SOLENOID VALVE (7) is three-way normally closed type arranged so cylinder port is mounted to HYDRAULIC CYLINDER (10) port. SOLENOID VALVE (7) drain port is connected by TUBING (8) to DRAIN (18) which is threaded to enable connection to engine lube oil sump. SOLENOID VALVE (7) source port is connected by TUBING (8) to out port of restricted forward flow/full reverse flow CHECK VALVE (9). SOLENOID VALVE (7) is constructed so that with no electrical signal applied, included cylinder port is connected to included drain port; with electrical signal applied, source port is connected to cylinder port.

Controlled Check Valve means—CHECK VALVE (9) is threaded at in port for connection to engine lube oil pressure. CHECK VALVE (9) out port accepts TUBING (8). CHECK VALVE (9) contains adjustable orifice in restricted forward flow path from in port to out port. Reverse full flow path from out port to in port is blocked by included one way valve whenever higher pressure is applied to in port than to out port. Application of higher pressure to out port connects reverse full flow path between out port and in port by release of included one way valve.

Pivot Lever means—PIVOT LEVER (14) is an inverted J shaped bracket attached by PIVOT (13) to LINEAR TRANSLATION BRACKET (5) in two places such as to allow positioning of elements and manual control through a range of movement by KNOB (20) screwed upon THREADED SHAFT (21) rigidly attached to PIVOT LEVER (14). AXLE (15) passes through PIVOT LEVER (14), in close but non-binding fit, in two places, and attaches solidly to MOUNTING PLATE (17).

Mounting Plate means—MOUNTING PLATE (17) is a rigid piece drilled and arranged to accept AXLE (15), movement of THREADED SHAFT (21) in slot and THROTTLE POSITION SENSOR (16).

Sensor means—THROTTLE POSITION SENSOR (16) is a simple snap-action lever switch attached to MOUNTING PLATE (17) and positioned so PIVOT LEVER (14) will actuate THROTTLE POSITION SENSOR (16) at full forward position of LINEAR TRANSLATION BRACKET (5) allowed by full HYDRAULIC CYLINDER ROD (11) travel in forward actuated direction.

Operation

In "off" stand-by mode: Wired or wireless remote (or local) start/on button is pressed. Circuit board control causes starter to crank and IDLE SOLENOID (1) is energized, pushing IDLE SOLENOID ARMATURE (2) against THROTTLE ROD ADJUSTER DISC (3) which pulls THROTTLE ROD (4) forward through guide holes in LINEAR TRANSLATION BRACKET (5) compressing THROTTLE ROD RETURN SPRING (6) and advancing spring-coupled engine throttle to start position. Circuitry powers SOLENOID VALVE (7) allowing pressurized engine oil to begin flowing through TUBING (8) from restricted forward flow/full reverse flow CHECK VALVE (9) in restricted forward direction, through SOLENOID VALVE (7) "source" to "cylinder" path and into HYDRAULIC CYLINDER (10). Glow plug circuit is also time period energized. If start/on button is released prior to engine start, or upon engine start, then depressing start/on button will not crank starter until oil pressure decreases below oil pressure sensor threshold after engine stops. When engine does start and start/on button is released, if oil pressure is not above sensor threshold, IDLE SOLENOID (1) is de-energized, releasing THROTTLE ROD (4), THROTTLE ROD RETURN SPRING (6) returns THROTTLE ROD (4) to "off" position and engine stops. If instead, engine oil pressure is above threshold when engine starts and start/on button is released, engine will run at timed idle since IDLE SOLENOID (1) will remain energized until time period expires as determined by circuit board timer. If HYDRAULIC CYLINDER ROD (11) does not advance directly attached LINEAR TRANSLATION BRACKET (5) prior to IDLE SOLENOID (1) being de-energized, engine stops. If HYDRAULIC CYLINDER (10) does receive sufficient oil to advance HYDRAULIC CYLINDER ROD (11) prior to IDLE SOLENOID (1) being de-energized, THROTTLE ROD (4) will be held by advanced LINEAR TRANSLATION BRACKET (5) at, or above, idle and be further advanced gradually to full-forward position as HYDRAULIC CYLINDER (10) fills up and compresses CYLINDER RETURN SPRING (12). As HYDRAULIC CYLINDER ROD (11) approaches forward end of travel, LINEAR TRANSLATION BRACKET (5) has pulled PIVOT (13) coupled PIVOT LEVER (14) on AXLE (15) sufficiently forward on PIVOT (13)s to actuate THROTTLE POSITION SENSOR (16) attached to MOUNTING PLATE (17), and thereby electrical load is switched on by circuit board control. If oil pressure loss or other fault is sensed at any time while engine is running, circuitry will disconnect load and de-energize SOLENOID VALVE (7). SOLENOID VALVE (7) "source" to "cylinder" path is blocked and "cylinder" to "drain" path is connected to DRAIN (18) from HYDRAULIC CYLINDER (10). Compressed CYLINDER RETURN SPRING (12) causes HYDRAULIC CYLINDER (10) to begin emptying causing throttle to retract to "off" position determined by PARK SCREW (19) adjustment on LINEAR TRANSLATION BRACKET (5). Engine stops. If oil pressure fails but is not sensed due to a faulty sensor circuit component, HYDRAULIC CYLINDER (10) drains through "cylinder" to "source" path of SOLENOID VALVE (7) into engine through released check valve of full reverse flow path of restricted forward flow/full reverse flow CHECK VALVE (9) causing THROTTLE POSITION SENSOR (16) to be released, disconnecting load and engine stops as retracting HYDRAULIC CYLINDER ROD (11) carries LINEAR TRANSLATION BRACKET (5) and THROTTLE ROD (4) returns to "off". When start/on then stop buttons are pressed while engine is running, IDLE SOLENOID (1) is energized, load is disconnected, SOLENOID VALVE (7) is deenergized causing HYDRAULIC CYLINDER (10) to drain through same path as in sensed fault mode, and throttle retracts to idle position as assembly's LINEAR TRANSLATION BRACKET (5) approaches park position but extended IDLE SOLENOID ARMATURE (2) holds THROTTLE ROD (4) in idle position. Engine idles for set time, then IDLE SOLENOID (1) is de-energized and engine stops. If stop button only is pressed, then engine stops quickly as if in sensed fault mode. If stop button is pressed, but a change of mind occurs, pressing start/on button prior to engine stop will re-energize SOLENOID VALVE (7) causing engine to smoothly regain speed and reconnect load upon reaching operating speed.

In "idle" standby mode: Operation same as described above except that when stop button is pressed, IDLE SOLENOID (1) is energized and throttle held at idle position until start/on button sets circuitry to cause engine to regain speed and load to switch on.

Manual over-ride: If automatic operation is disabled, engine may be controlled manually by advancing PIVOT LEVER (14) through slot of MOUNTING PLATE (17) by KNOB (20) on THREADED SHAFT (21) attached tp PIVOT LEVER (14). KNOB (20) may be tightened down on THREADED SHAFT (21) and MOUNTING PLATE (17) so as to lock throttle in any desired position. In manual mode, PIVOT LEVER (14) moves LINEAR TRANSLATION BRACKET (5) whereas in automatic mode PIVOT LEVER (14) is moved by LINEAR TRANSLATION BRACKET (5).

Note: IDLE SOLENOID (1) spatial relationship to THROTTLE ROD ADJUSTER DISC (3) is maintained by IDLE SOLENOID MOUNT (22) attachment to HYDRAULIC CYLINDER (10).

I claim:

1. For an internal combustion engine having a pressurized lube oil system, starter and fuel metering speed control, a remote-controlled engine start/stop device providing engine protection fault shut-down, adjustable rate gradual engine speed increase, an adjustable engine warm-up period automatically varied by at least one of engine and ambient temperature, engine load on/off switching, engine cool-down prior to stop upon no-fault turn-off, selectable idle/off standby and manual override, comprising, in combination;

(a) adjustable throttle rod attachment means, connectable to an engine fuel metering speed control and operatively associated with a translation bracket means to provide an operative range upon fuel metering speed control by an electrical solenoid means and an hydraulic actuator means;

(b) translation bracket means, operatively associated with said adjustable attachment means, an electrical solenoid means and an hydraulic actuator means, and arranged to enable hydraulic actuator means override and disengagement of said electrical solenoid means by its movement to acheive;

(1) reset of engine fuel metering speed control to off position by said adjustable attachment means upon engine cutoff, (2) movement of said adjustable attachment means and engine fuel metering speed control by said electrical solenoid means to an engine start/idle position during start/idle conditions, and (3) upon engine operation above idle speed, said electrical solenoid means is inoperative upon the adjustable attachment means with full positioning control asserted by said hydraulic actuator means;

(c) electrical solenoid means permitting remote operation and control by engine condition transducers, said electrical solenoid means having movable member means so arranged and held to act upon and impart motion to said adjustable attachment means, and thereby to said fuel metering speed control, by an electrical signal, between two positions, the first being engine off and the second when an engine starter is operated and when idle mode is selected;

(d) hydraulic actuator means having movable member means operatively associated with said translation bracket means to provide a range of movement to said translation bracket means, for actuating said engine fuel metering speed control between off and operating speed positions by travel of said adjustable attachment means, upon application over time of fluid pressure to port means of said hydraulic actuator means;

(e) stored energy means including movable member means operatively associated therewith, and arranged to compel return of said adjustable attachment means upon loss of operating fluid pressure at said hydraulic actuator means, to an engine off position whenever said electrical solenoid means is not energized and an engine start/idle position whenever said electrical solenoid means is energized;

(f) electrical solenoid valve means providing remote operation and control by engine condition transducers, said electrical solenoid valve means containing and controlling a choice of two fluid pressure path means, the first path means connecting a source port to a cylinder port, said cylinder port comminicating with said hydraulic actuator means to provide throttle advance, the second path means connecting said cylinder port to a drain port, said drain port arranged to permit fluid travel to an engine lube oil sump from said cylinder port whenever throttle-down is desired;

(g) controlled check valve means, containing adjustable orifice means, permitting an adjustable rate of restricted fluid flow in a forward flow direction and full reverse flow in the other direction, said controlled check valve means having an inlet port means communicating with said engine pressurized lube oil system to allow pressurized fluid travel by way of said adjustable restricted forward flow path means, through an outlet port means in communication with said source port of said electrical solenoid valve means and said outlet port means in communication with said source port of said electrical solenoid valve means, back to said inlet port means by way of said check valve means arranged to allow full reverse flow of fluid from said outlet port means to said inlet port means whenever fluid pressure present at said outlet port means is greater than fluid pressure present at said inlet port means, whereas greater pressure at said inlet port means causes said path to be blocked by operation of said check valve means, said full reverse flow path permits movement of an apparatus to adjust said engine fuel metering speed control to off, upon fluid pressure loss, regardless of possible malfunctions, thereby obviating need for an engine oil pressure fault transducer;

(h) sensor means operatively associated with said apparatus to be manipulated at a point of said apparatus travel corresponding to engine load, to enable connection and disconnection of engine load;

(i) mounting plate means operatively connected to said apparatus such as to maintain a spatial relationship of apparatus elements and concurrently provide means of attachment to an engine; and (j) pivot lever means operatively associated with the apparatus and arranged for permitting movement and positioning of said adjustable attachment means, by manual force, through a range of operation of engine fuel metering speed control.

2. A device as set forth in claim 1 wherein said sensor means is a proximity sensor means in combination with associated circuitry means arranged to detect speed directly and thereby provide a load switching function.

3. A device as set forth in claim 1 wherein said sensor means is a frequency sensor means in combination with associated circuitry means arranged to detect generator frequency directly and thereby provide a load switching function.

* * * * *